US006935852B2

(12) United States Patent
Iida et al.

(10) Patent No.: US 6,935,852 B2
(45) Date of Patent: Aug. 30, 2005

(54) SCROLL COMPRESSOR HAVING A BACK PRESSURE CHAMBER COMPRISING HIGH AND MIDDLE PRESSURE CHAMBERS

(75) Inventors: Noboru Iida, Shiga (JP); Atsushi Sakuda, Shiga (JP); Akira Hiwata, Shiga (JP); Kiyoshi Sawai, Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 23 days.

(21) Appl. No.: 10/470,345

(22) PCT Filed: Jan. 29, 2002

(86) PCT No.: PCT/JP02/00638

§ 371 (c)(1),
(2), (4) Date: Jul. 28, 2003

(87) PCT Pub. No.: WO02/061285

PCT Pub. Date: Aug. 8, 2002

(65) Prior Publication Data

US 2004/0067144 A1 Apr. 8, 2004

(30) Foreign Application Priority Data

Jan. 29, 2001 (JP) ..... 2001-019544

(51) Int. Cl.[7] ..... F04C 18/00
(52) U.S. Cl. ..... 418/55.5; 418/57; 418/55.6
(58) Field of Search ..... 418/55.5, 57, 55.6, 418/55.4

(56) References Cited

U.S. PATENT DOCUMENTS 5,645,408 A * 7/1997 Fujio et al. ..... 418/55.4

FOREIGN PATENT DOCUMENTS

| | | |
|---|---|---|
| EP | 0 822 335 | 2/1998 |
| JP | 05-187369 | 7/1993 |
| JP | 05-306689 | 11/1993 |
| JP | 11-22665 | 1/1999 |
| JP | P2000-213476 A | 8/2000 |

* cited by examiner

*Primary Examiner*—Theresa Trieu
(74) *Attorney, Agent, or Firm*—McDermott Will & Emery LLP

(57) ABSTRACT

A scroll compressor, whose back pressure is easily controlled and compression efficiency is high, is provided. The scroll compressor includes a plurality of compression chambers formed by engaging a fixed-scroll wrap and an orbiting-scroll wrap, and a back pressure chamber formed at an opposite side of the orbiting-scroll wrap of a orbiting-scroll. The scroll compressor additionally includes a high pressure chamber and a middle pressure chamber, which are formed by dividing the back pressure chamber using a seal. Moreover, the scroll compressor includes a first path for supplying lube oil from the high pressure chamber to the middle pressure chamber, and a second path for supplying the lube oil from the middle pressure chamber to an suction chamber of the compression chambers. The first path is intermittently opened by orbit of the orbiting-scroll.

4 Claims, 4 Drawing Sheets

SCROLL COMPRESSOR HAVING A BACK PRESSURE CHAMBER COMPRISING HIGH AND MIDDLE PRESSURE CHAMBERS

TECHNICAL FIELD

The present invention relates to a scroll compressor used in a refrigerating cycle apparatus or the like, and more particularly to a scroll compressor which efficiently works by supplying an appropriate amount of lube oil to compression chambers.

BACKGROUND ART

A scroll compressor has a low vibration and low noise characteristic. Moreover, in the scroll compressor, compressed fluid flows in one direction, so that fluid resistance becomes small in high speed operation. Therefore, the scroll compressor has high compression efficiency, and becomes widespread.

The conventional scroll compressor is formed as follows. A motor and a compressing device are placed in a hermetic shell, and the compressing device forms a plurality of compression chambers by engaging a fixed-scroll parts and a orbiting-scroll parts. In addition, refrigerant gas or the like for air conditioning is sucked and compressed by moving the compression chambers toward a center of a scroll of the orbiting-scroll parts with its volume reducing.

A tank for high pressured lube oil is disposed at the opposite side of a orbiting-scroll wrap of the orbiting-scroll parts, where the high pressured lube oil lubricates and cools a bearing or a crankshaft of the orbiting-scroll parts. Besides, a chamber where a rotation-restricting parts is disposed for preventing rotation of the orbiting-scroll parts is linked to the tank via a decompression part. The high pressured lube oil is decompressed at the decompression part and supplied to the rotation-restricting parts for lubricating. Furthermore, the lube oil is supplied from the chamber to an suction chamber of the compression chambers via a pressure-controlling device. Thus the lube oil has roles of a seal for preventing a leak of the compressed refrigerant gas or the like in the compression chambers, and lubrication of a contacting surface between a fixed wrap of the fixed-scroll parts and the orbiting-scroll wrap of the orbiting-scroll parts.

However, in the structure mentioned above, an inside diameter of a fine hole has to be smaller and a path length of the fine hole has to be longer to make decompression effect at the decompression part more effective. In that case, the fine hole tends to be closed with dust or the like, so that the characteristics of the compressor deteriorate and processing thereof becomes complicated.

Moreover, when compression ratio or an absolute value of pressure difference between high pressure and low pressure is large, a flow of the lube oil to the suction chamber increases, so that compression efficiency deteriorates.

An object of the present invention is to provide easy processing of a hole of a decompression part, and a scroll compressor which efficiently works by supplying an appropriate amount of lube oil to compression chambers.

SUMMARY OF THE INVENTION

A scroll compressor includes the following elements:

a fixed-scroll member having a fixed-scroll wrap and a fixed plate, an orbiting-scroll member having an orbiting-scroll wrap and an orbiting plate, a plurality of compression chambers formed by engaging the fixed-scroll wrap and the orbiting-scroll wrap, a back pressure chamber formed at an opposite side of the orbiting-scroll wrap of the orbiting-scroll, a high pressure chamber and a middle pressure chamber, which are formed by dividing the back pressure chamber using a seal, a first path for supplying lube oil from the high pressure chamber to the middle pressure chamber, a second path for supplying the lube from the middle pressure chamber to a suction chamber of the compression chambers, where a fluid in the compression chambers is compressed by reducing a volume of the compression chambers toward a center of a scroll of the orbiting-scroll using orbit of the orbiting-scroll, and the first path is intermittently opened by the revolution of the orbiting-scroll.

Using the structure discussed above, the high pressure chamber and the middle pressure chamber of the back pressure chamber are intermittently linked to each other by the revolution of the orbiting-scroll member. Therefore, decompression effect becomes more effective without reducing a diameter of a hole of the path. As a result, processing of the hole becomes easy. In addition, an appropriate amount of lube oil can be supplied to the suction chamber, and controlling of pressure of the back pressure chamber becomes easy. Thus, working with high compression efficiency can be obtained.

In the scroll compressor discussed above, the first path is preferably formed at the orbiting plate, and linked to the high pressure chamber and the middle pressure chamber so that an opening of a high-pressure-chamber side of the first path is intermittently opened by the revolution of the orbiting-scroll. As a result, controlling of decompression becomes easy and effective without reducing the diameter of the hole of the path.

In the scroll compressor discussed above, the first path is preferably formed at the orbiting plate, and linked to the high pressure chamber and the middle pressure chamber so that an opening of a middle-pressure-chamber side of the first path is intermittently opened by the orbit of the orbiting-scroll. As a result, controlling of decompression becomes easy and effective without reducing the diameter of the hole of the path.

More preferably, the orbiting plate of the orbiting-scroll comes in contact with the fixed plate of the fixed-scroll by applying constant pressure on a back of the orbiting-scroll. A concave part, which is opened to the middle pressure chamber, is formed on the contact surface of the fixed plate, and the opening of the middle pressure chamber of the first path and the concave part are intermittently linked to each other by the revolution of the orbiting-scroll. As a result, processing of a path becomes easy.

DETAILED DESCRIPTION OF PREFERRED EMBODIMENTS

First Exemplary Embodiment

Figure 1:
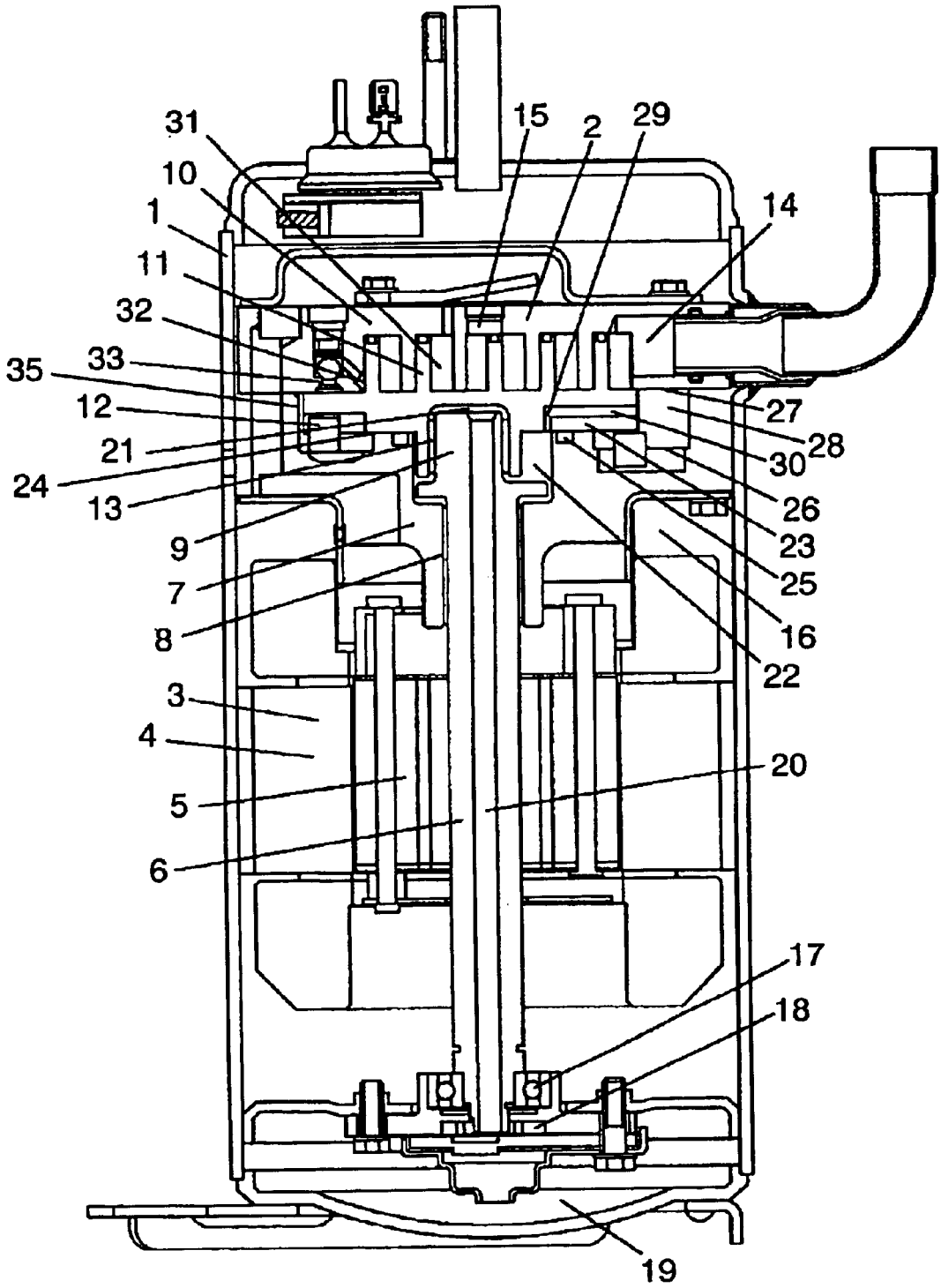
FIG. 1 is a sectional view of a scroll compressor in accordance with a first exemplary embodiment of the present invention.

FIG. 1 shows a structure of a scroll compressor in accordance with the exemplary embodiment of the present invention. Compressing device 2 and motor 3 are placed in hermetic shell 1. Motor 3 includes stator 4, which is fixed inside hermetic shell 1, and rotor 5 rotatably sustained inside stator 4. Driving shaft 6 penetrates rotor 5, and is coupled thereto. One end of driving shaft 6 is rotatably sustained at bearing 8, which is fixed to bearing parts 7 forming a part of compressing device 2. The tip of driving shaft 6 sustained at bearing 8 is equipped with crankshaft 9, which provides eccentric movement for driving shaft 6.

In addition, a plurality of compression chambers 31 are formed by engaging fixed-scroll 10 and orbiting-scroll 11. Orbiting-scroll 11 is prevented from rotating by rotation-restricting parts 12, and only revolved by crankshaft 9 via orbiting-bearing 13. Orbiting-scroll 11 moves, with a volume of the compression chambers reducing toward a center of a scroll of the orbiting-scroll. At that time, refrigerant gas or the like is sucked from suction port 14 and compressed toward the center. The compressed refrigerant gas or the like is discharged to chamber 16 in the hermetic shell via discharge port 15.

Other end of driving shaft 6 is sustained by bearing parts 17, and has positive displacement pump 18 at its tip. Lube oil is pooled in lower side oil tank 19 disposed at a lower side of hermetic shell 1. The pooled lube oil is supplied to upper side oil path 21 of an upper side of crankshaft 9 via oil path 20 by pump 18, where oil path 20 is formed at a center of driving shaft 6 in the shaft direction and used for supplying the lube oil. Then the lube oil lubricates and cools eccentric-bearing 13, lubricates bearing 8 via oil chamber 22 and returns to lower side oil tank 19.

A lower surface of orbiting plate 23, which forms orbiting-scroll 11, is spaced from an upper surface of bearing parts 7 at a given distance, and sealed with annular seal 25 which is formed at upper part 24 of bearing parts 7.

Rotation-restricting parts 12 is disposed at recess 26 formed at bearing parts 7. At an upper side of recess 26, chamber 28 is formed by fixed plate 27 of fixed-scroll 10, orbiting plate 23 and bearing parts 7. Oil chamber 22 and chamber 28 are closed with annular seal 25, however, they can be linked to each other via hole 29 and long hole 30 formed at orbiting plate 23. Chamber 16 is linked to oil chamber 22 via bearing 8 and the like. Oil chamber 22 forms a high pressure chamber and recess 26 forms a middle pressure chamber.

Part of the lube oil supplied to oil chamber 22 is supplied to recess 26 and chamber 28 via hole 29 and long hole 30, and lubricates rotation-restricting parts 12 disposed at recess 26.

According as the lube oil supplied to chamber 28 is pooled, pressure in chamber 28 increases. Pressure-controlling device 33 is disposed between chamber 28 and suction chamber 32, which forms compression chambers 31, for keeping pressure of chamber 28. When pressure in chamber 28 is higher than predetermined pressure, pressure-controlling device 33 works and the lube oil in chamber 28 is supplied to suction chamber 32. Thus, pressure in chamber 28 is kept constant. The lube oil supplied to suction chamber 32 is led to compression chambers 31, and has roles of a seal for preventing a leak of compressed refrigerant gas or the like, and lubrication of a contacting surface between fixed-scroll 10 and orbiting-scroll 11.

Pressure for discharging of the scroll compressor, pressure in oil chamber 22, pressure in chamber 28 and pressure in suction chamber 32 are controlled. Particularly, pressure in chamber 28 is controlled in a manner to be higher than pressure in the suction chamber for pressing orbiting-scroll 11 into fixed-scroll 10. Sizes of hole 29 and long hole 30 for linking oil chamber 22 to chamber 28 are controlled by pressure-controlling device 33 for obtaining certain pressure.

In this embodiment, a path for linking oil chamber 22 to chamber 28 is formed by hole 29 and long hole 30. As shown in FIG. 1, hole 29 is intermittently opened to oil chamber 22 by annular seal 25.

Figure 2:
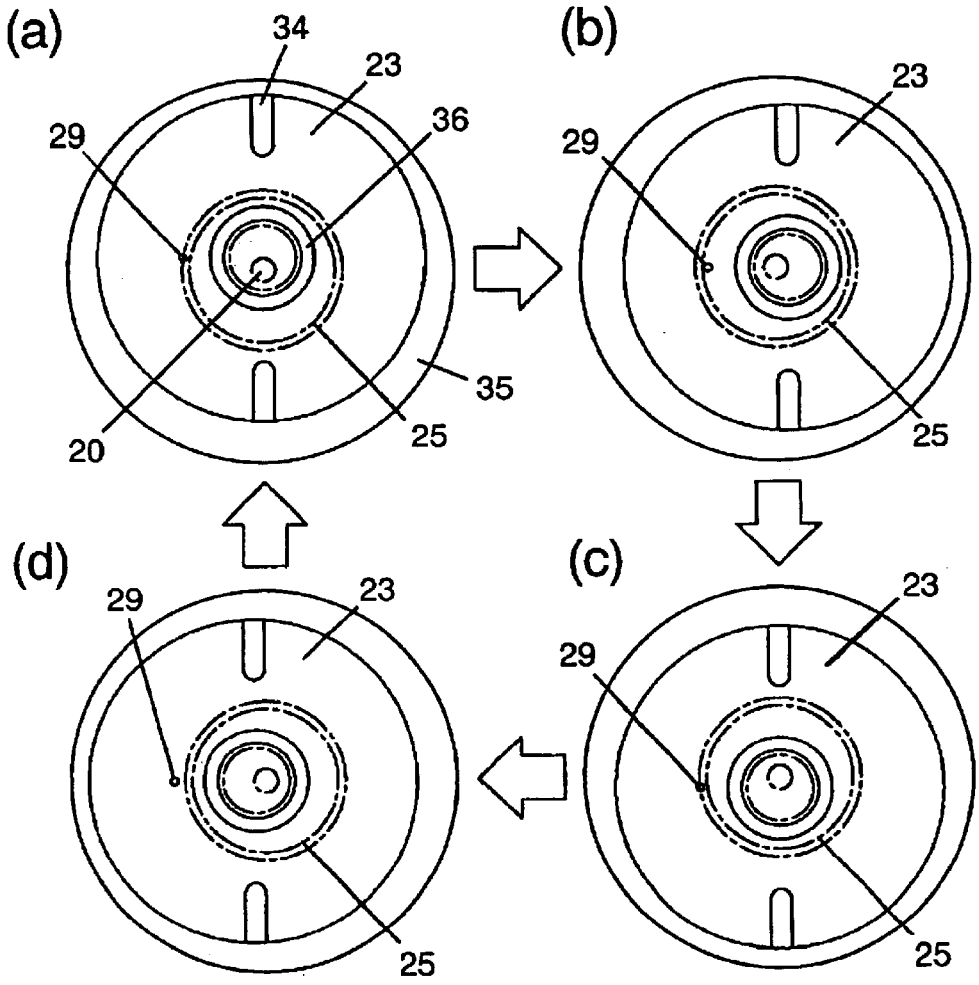
FIGS. 2(*a*)–2(*d*) are a plan view showing a positional relation between a fixed-scroll and a orbiting-scroll at a certain circled position of the orbiting-scroll in accordance with the first exemplary embodiment of the present invention.

The operation is described hereinafter with reference to FIG. 2. FIG. 2 shows a bottom plan view of orbiting plate 23 of orbiting-scroll 11. In FIG. 2, an outermost circle denotes circumference 35 of chamber 28 of bearing parts 7, and oil path 20 formed in driving shaft 6 is positioned at a center thereof. Guide groove 34 of rotation-restricting parts 12 is disposed at orbiting plate 23, and hole 29 is disposed at orbiting plate 23 and forms a path for linking oil chamber 22 to chamber 28. Besides, flange 36 forms a bearing, which is disposed at a circumference of eccentric-bearing 13, and oil chamber 22.

FIG. 2 shows a relative positional relation between hole 29 and annular seal 25 formed at bearing parts 7 when orbiting-scroll 11 revolves. Orbiting-scroll 11 revolves in an eccentric condition for circumference 35 of chamber 28, as shown in order of arrows of FIGS. 2(*a*)–2(*d*). In this condition, a high pressure chamber is formed inside a circumference of annular seal 25, and a middle pressure chamber is formed outside the circumference of annular seal 25. Accordingly, only when hole 29 is placed inside the circumference of annular seal 25, oil chamber 22 of the high pressure chamber is linked to chamber 28 of the middle pressure chamber. Thus, lube oil in oil chamber 22 is supplied to chamber 28. Among FIGS. 2(*a*)–2(*d*), only FIG. 2(*b*) shows a state where the lube oil can be supplied.

In a conventional scroll compressor, lube oil is continuously supplied. However, as discussed above, in this invention, lube oil is intermittently supplied. Thus, even when the scroll compressor of this invention has the same hole size of the conventional one, an amount of supply can be saved. In addition, supply of the lube oil from the middle pressure chamber to the suction chamber can be controlled. Furthermore, processing becomes easy because the hole can be made bigger. As a result, stable working with high compression efficiency can be obtained. Besides, supply of the lube oil can be controlled by changing a diameter of the hole or the number of the hole, or changing time for linking by varying a position of annular seal 25 in orbit.

Second Exemplary Embodiment

Figure 3:
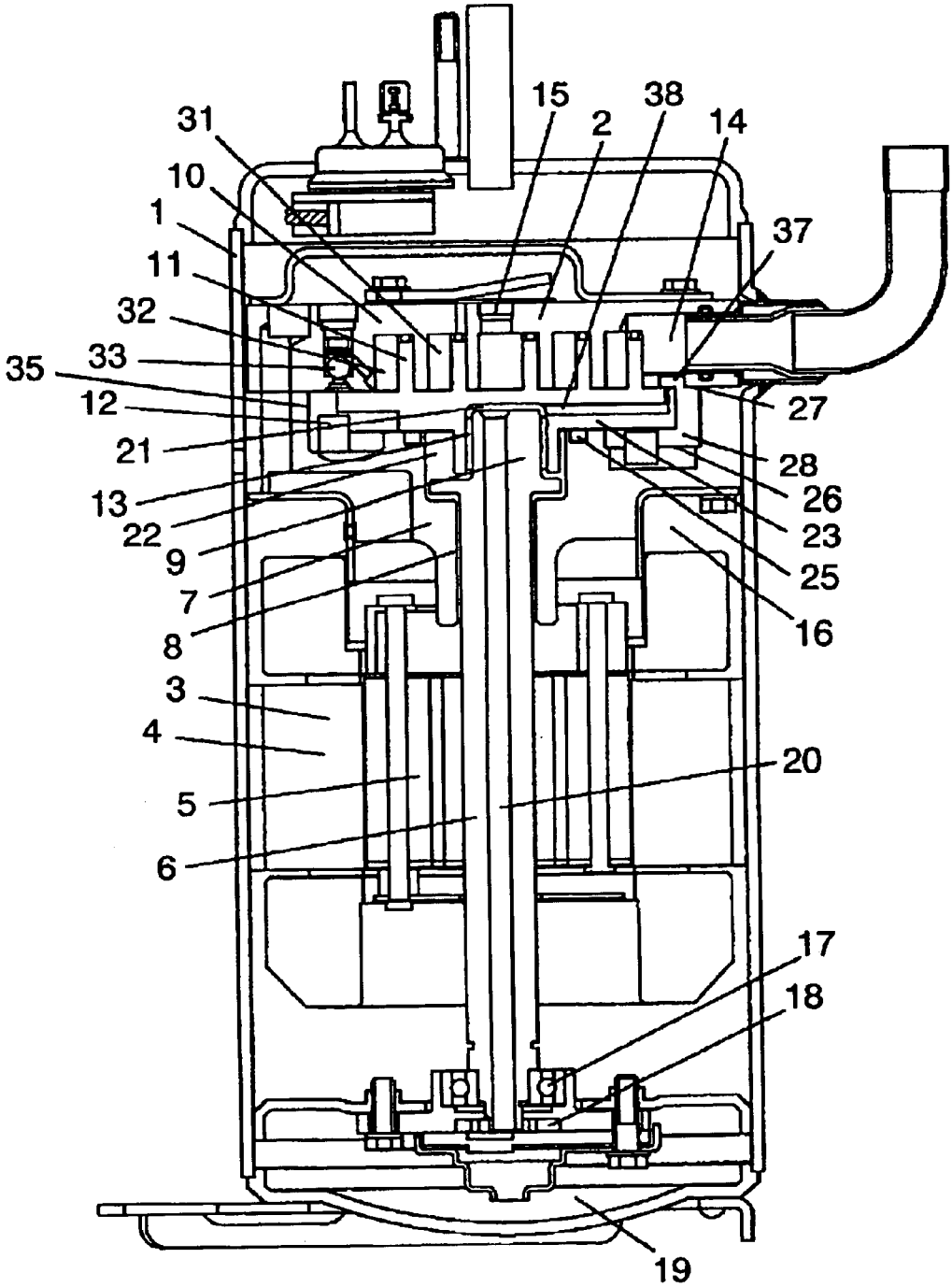
FIG. 3 is a sectional view of a scroll compressor in accordance with a second exemplary embodiment of the present invention.

FIG. 3 shows a structure of a scroll compressor in accordance with the exemplary embodiment of the present invention. This embodiment differs from the embodiment shown in FIG. 1 in the following structure. As shown in FIG. 3, orbiting plate 23 has long hole 38 whose one end is linked to upper side oil path 21 and other end is linked to concave part 37 formed at fixed plate 27 of fixed-scroll member 10. Concave part 37 is linked to chamber 28 which operates as a middle pressure chamber. Upper side oil path 21 and chamber 28 are closed with annular seal 25.

As discussed above, a difference between this embodiment and the first embodiment is only a structure of a path from a high pressure chamber to the middle pressure chamber. In the first embodiment, hole 29 linked to oil chamber 22, which operates as the high pressure chamber, is intermittently opened. However, in this embodiment, long hole 38 linked to the middle pressure chamber is intermittently opened. Other structures are the same as those of the first embodiment, and the description of those structures are omitted here.

Figure 4:
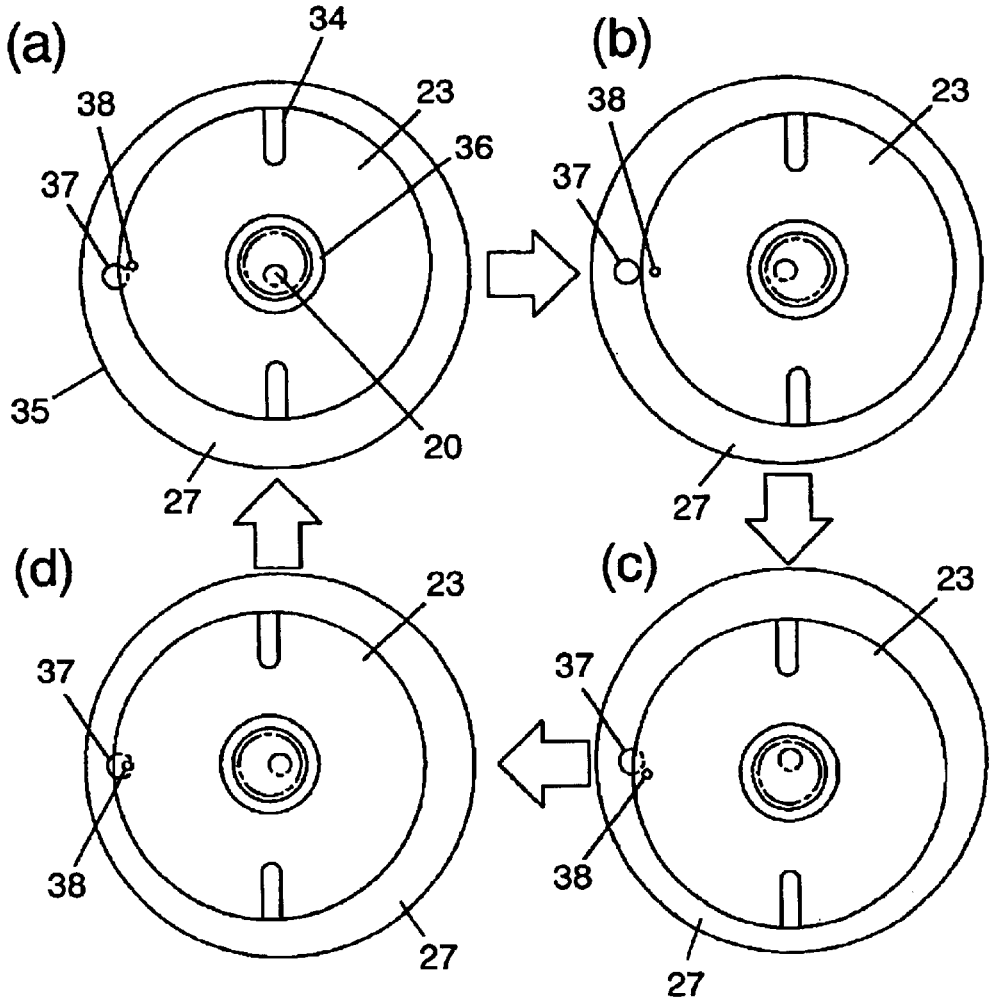
FIGS. 4(*a*)–4(*d*) are a plan view showing a positional relation between a fixed-scroll and a orbiting-scroll at a certain circled position of the orbiting-scroll in accordance with the second exemplary embodiment of the present invention.

The operation is described hereinafter with reference to FIG. 4. FIG. 4 is a plan view showing a positional relation between orbiting plate 23 of orbiting-scroll 11 and concave part 37 formed at fixed plate 27. In FIG. 4, an outermost circle denotes circumference 35 of chamber 28 of bearing parts 7, and oil path 20 formed in driving shaft 6 is positioned at a center thereof. Guide groove 34 of rotation-restricting parts 12 is disposed at orbiting plate 23, and long hole 38 is disposed at orbiting plate 23 and forms a path for linking upper side oil path 21 to chamber 28. Besides, flange 36 forms a bearing of a circumference of orbiting-bearing 13.

FIG. 4 shows a relative positional relation between long hole 38 and concave part 37 formed at fixed plate 27 when orbiting-scroll 11 revolves. Orbiting plate 23 of orbiting-scroll 11 revolves in an eccentric condition for circumference 35 of chamber 28, as shown in order of arrows of FIGS. 4(*a*)–4(*d*). In the condition of FIG. 4(*d*), long hole 38 is entirely linked to concave part 37, and lube oil is supplied from upper side oil path 21 to chamber 28. In other conditions, upper side oil path 21 is linked to chamber 28 via a gap between fixed plate 27 and orbiting plate 23. However, because resistance at the gap is large, little lube oil is supplied. In other words, an amount of lube oil can be controlled by the resistance at the gap.

In a conventional scroll compressor, lube oil is continuously supplied. However, as discussed above, in this invention, lube oil is intermittently supplied. Thus, even when the scroll compressor of this invention has the same hole size of the conventional one, an amount of supply can be saved. In addition, supply of the lube oil from the middle pressure chamber to the suction chamber can be controlled. Furthermore, processing becomes easy because the hole can be made bigger. As a result, stable working with high compression efficiency can be obtained. Besides, supply of the lube oil can be controlled by changing a diameter of the long hole or the concave part, the number of the long hole and the concave part or time when long hole 38 is linked to concave part 37. In addition, a shape of long hole 38 is not necessarily a circular shape shown in FIG. 4.

This invention is useful for a case where compression ratio and pressure difference between high pressure and low pressure are large. This invention is also useful for a case where compression ratio is not large but an absolute value of the pressure difference is large, for example, a case of using refrigerant gas such as carbon dioxide gas. Moreover, in this invention, the positive displacement pump is used for supplying the lube oil, however, the same effect can be obtained using a differential-pressure oil pump.

INDUSTRIAL APPLICABILITY

As discussed above, in this invention, a high pressure chamber and a middle pressure chamber of a back pressure chamber are intermittently linked to each other by revolution of a orbiting-scroll. Therefore, decompression effect becomes more effective without reducing a diameter of a hole of a path. As a result, processing of the hole of a decompression part becomes easy. In addition, an appropriate amount of lube oil can be supplied to the suction chamber, and controlling of pressure in the back pressure chamber becomes easy. Thus, a scroll compressor, which works with high compression efficiency, can be provided.

| Reference marks in the drawings | |
|---|---|
| 1 | hermetic shell |
| 2 | compressing device |
| 3 | motor |
| 4 | stator |
| 5 | rotor |
| 6 | driving shaft |
| 7, 17 | bearing part |
| 8 | bearing |
| 9 | crankshaft |
| 10 | fixed-scroll |
| 11 | orbiting-scroll |
| 12 | rotation-restricting part |
| 13 | eccentric-bearing |
| 14 | suction port |
| 15 | discharge port |
| 16 | chamber in a hermetic shell |
| 18 | positive displacement pump |
| 19 | lower side oil tank |
| 20 | oil path |
| 21 | upper side oil path |
| 22 | oil chamber |
| 23 | orbiting plate |
| 24 | upper part |
| 25 | annular seal |
| 26 | recess |
| 27 | fixed plate |
| 28 | chamber |
| 29 | hole |
| 30 | long hole |
| 31 | compression chamber |
| 32 | suction chamber |
| 33 | pressure-controlling device |
| 34 | guide groove |
| 35 | circumference |
| 36 | flange |
| 37 | concave part |
| 38 | long hole |

What is claimed is:

1. A scroll compressor comprising:

a fixed-scroll having a fixed-scroll wrap and a fixed plate;

an orbiting-scroll having an orbiting-scroll wrap and an orbiting plate;

a plurality of compression chambers formed by engaging the fixed-scroll wrap and the orbiting-scroll wrap;

a back pressure chamber formed at an opposite side of the orbiting-scroll wrap of the orbiting-scroll;

a high pressure chamber and a middle pressure chamber, which are formed by dividing the back pressure chamber using a seal;

a first path for supplying lube oil from the high pressure chamber to the middle pressure chamber; and a second path for supplying the lube oil from the middle pressure chamber to a suction chamber of the compression chambers, wherein a fluid in the compression chambers is compressed by reducing a volume of the compression chambers toward a center of a scroll of the orbiting-scroll using orbit of the orbiting-scroll, and the first path is intermittently opened by the revolution of the orbiting-scroll, wherein a pressure-controlling device is formed at the second path.

2. The scroll compressor of claim 1, wherein the first path is formed at the orbiting plate, and linked to the high pressure chamber and the middle pressure chamber, wherein an opening of a side of the high pressure chamber of the first path is intermittently opened by the orbit of the orbiting-scroll.

3. The scroll compressor of claim 1, wherein the first path is formed at the orbiting plate, and linked to the high pressure chamber and the middle pressure chamber, wherein an opening of a side of the middle pressure chamber of the first path is intermittently opened by the revolution of the orbiting-scroll.

4. The scroll compressor of claim 3, wherein the orbiting plate of the orbiting-scroll comes in contact with the fixed plate of the fixed-scroll by applying constant pressure on a back of the orbiting-scroll, wherein a concave part, which is opened to the middle pressure chamber, is formed on the contact surface of the fixed plate, wherein the opening of the middle pressure chamber of the first path and the concave part are intermittently linked to each other by the orbit of the orbiting-scroll.

* * * * *